US007375605B2

(12) United States Patent
Goertz et al.

(10) Patent No.: US 7,375,605 B2
(45) Date of Patent: May 20, 2008

(54) METHOD AND DEVICE FOR COMPENSATING THE TEMPERATURE OF CIRCULAR RESONATORS

(75) Inventors: Franz-Josef Goertz, Burgstetten (DE); Dieter Wolk, Backnang (DE); Dietmar Schmitt, Wassenaar (NL); Juergen Damaschke, Heilbronn (DE)

(73) Assignee: Tesat-Spacecom GmbH & Co. KG, Backnang (DE)

( * ) Notice: Subject to any disclaimer, the term of this patent is extended or adjusted under 35 U.S.C. 154(b) by 260 days.

(21) Appl. No.: 10/546,228

(22) PCT Filed: Mar. 11, 2004

(86) PCT No.: PCT/DE2004/000494

§ 371 (c)(1),
(2), (4) Date: Nov. 10, 2005

(87) PCT Pub. No.: WO2004/082066

PCT Pub. Date: Sep. 23, 2004

(65) Prior Publication Data

US 2006/0109068 A1 May 25, 2006

(30) Foreign Application Priority Data

Mar. 11, 2003 (DE) ..... 103 10 862

(51) Int. Cl.
*H01P 7/06* (2006.01)
*H01P 1/30* (2006.01)

(52) U.S. Cl. ..... 333/229; 333/234

(58) Field of Classification Search ..... 333/229, 333/234
See application file for complete search history.

(56) References Cited

U.S. PATENT DOCUMENTS

| | | | |
|---|---|---|---|
| 2,528,387 | A | 10/1950 | Frederick |
| 3,786,379 | A | 1/1974 | Lutchansky |
| 4,057,772 | A | 11/1977 | Basil, Jr. et al. |
| 5,027,090 | A | 6/1991 | Gueble et al. |

FOREIGN PATENT DOCUMENTS

| | | |
|---|---|---|
| DE | 39 35 785 | 5/1991 |
| DE | 43 19 886 | 7/1994 |
| EP | 0 939 450 | 9/1999 |
| WO | WO-87/03745 | 6/1987 |

*Primary Examiner*—Robert J. Pascal
*Assistant Examiner*—Kimberly E Glenn
(74) *Attorney, Agent, or Firm*—Jordan and Hamburg LLP

(57) ABSTRACT

A method and an arrangement for temperature compensation at circular resonators with dual mode utilization, which includes a material with a low coefficient of thermal expansion and for which the tensile or compressive forces are transferred to the resonator wall and produce elastic deformations there. The resonator wall is deformed in two mutually perpendicular directions in each case by the same absolute amount at one or more places along the axial e extent, the deformation forces being introduced into the resonator war over at least one flange. This has the advantage that the peripheral shape of the casing of the circular resonator is deformed so that both orthogonal dual modes experience uniform shortening with simultaneous expansion of the material, as a result of which a high compensation effect is achieved.

10 Claims, 3 Drawing Sheets

METHOD AND DEVICE FOR COMPENSATING THE TEMPERATURE OF CIRCULAR RESONATORS

BACKGROUND OF THE INVENTION:

The invention is based on a method and an arrangement for the temperature compensating at circular resonators with dual mode utilization for microwave filters realizable therefrom.

Circular resonators, which are used in operating environments in which the temperature fluctuates greatly, are equipped with various means for compensating for the thermal expansion caused by temperature fluctuations. A frequently employed principle for counteracting these thermal expansions consists of changing the volume of the circular resonators as a function of the temperature with the help of mechanical means in such a manner, that the transfer properties of the circular resonator are retained. Usually, devices are used for this purpose, which protrude into the interior of the circular resonator (DE 39 35 785) and change their volume there as a function of the temperature, so that the average frequency of the resonator remains constant. A further possibility consists of utilizing the effect of the resonator end faces (EP 0 939 450 A1, WO 87/03745). Compensating elements, which dip more or less into the interior of the resonator, can be adjusted only with difficulty and, because of the nonlinear field distortion, lead to a nonlinear frequency compensation.

In EP 0 939 450 A1, a circular resonator is closed off by an arrangement at the end face, which consists of two plates with different coefficients of thermal expansion, lying rigidly on top of one another. In WO 87/03745, a curved, thin copper plate protrudes at the end face into the interior of the circular resonator. For certain cases of application, for example, if, because of special quality requirements, so-called TE1 1n modes, with n>1, are used as working modes in circular resonators, the effect of end-side compensation becomes constantly less because of the unfavorable relationships between length and diameter. Especially at high frequencies (Ku, Ka or higher) this technique fails, since the necessary deformation of the end-side diaphragms no longer is sufficient. high frequencies (Ku, Ka or higher) this technique fails, since the necessary deformation of the end-side diaphragms no longer is sufficient.

An arrangement, for which the waveguide is clamped in at least one frame, the temperature-dependent expansion of which is less than that of the waveguide, can compensate for large temperature-dependent volume changes (DE 43 19 886). Moreover, at least at two mutually opposite places of its wall, the waveguide is connected non-positively with the frame. The frame and waveguide are connected non-positively over spacers, which transfer compression and tensile forces, resulting from the different thermal expansions of the frame and the waveguide, onto the waveguide wall and cause elastic deformations there. The end faces of the waveguide produce the bulk of the elastic deformation. Moreover, deformation forces may be transferred over spacers, disposed between the frame and the casing of the waveguide, also onto the frame and counteract undesirable buckling of the frame. The disadvantage of this solution consists therein that, at two opposite side walls, ribs are integrally molded as spacers to the spacers of the frame, that is, that the waveguide of the arrangement must be adapted for the temperature compensation, which is associated with additional expense.

SUMMARY OF THE INVENTION:

In comparison, the inventive method has the advantage that the cross-sectional shape of the casing of the circular resonator is deformed so that both orthogonal dual modes, in this case, especially the Te1 1n modes, which are mostly used, experience a uniform shortening with a simultaneous expansion of the material, as a result of which a high compensation effect is achieved. A supporting structure, includes an arrangement, which ensures a uniform, centrally symmetrical, radial effect on the casing of the circular resonator. In practice, at least two supporting structures are required, which surround the circular resonator coaxially. They consist of a material with a thermal expansion, which is clearly high than that of the material of the circular resonator and are connected at specific sites over spacers firmly with the flange of the circular resonator. The forces of the supporting structure, deforming because of the effect of temperature, are transferred at these places onto the circular resonator. In the regions, in which there are no spacers, the supporting structures do not contact the circular resonator, so that the flange can be deformed freely in these regions. The flange carries out a tilting and pushing movement under the deformation forces of the supporting structures. The forces, introduced into the flange, are transferred over the latter to the casing of the circular resonator, so that the latter is deformed so that compensation takes place on both modes simultaneously and uniformly. A further technical translation of the method consists of letting the forces act directly from outside in two mutually perpendicular directions on the resonator casing. This may be accomplished, for example, by two clamping elements, which are mutually offset by 90° and accommodate the resonator casing between their clamping jaws.

According to an advantageous development of the invention, two disk-shaped supporting structures are provided, which surround the circular resonator in semicircular fashion and are bolted to the flange.

In a further, advantageous development of the invention, the upper spacers consist of a material, the thermal coefficient of expansion of which is different from that of the lower spacers. By these means, the deformation of the resonator casing can be improved further.

Further advantages and advantageous developments of the invention may be inferred from the following description and the claims.

An example of the invention is described in greater detail in the following and shown in the drawings.

Figure 1:
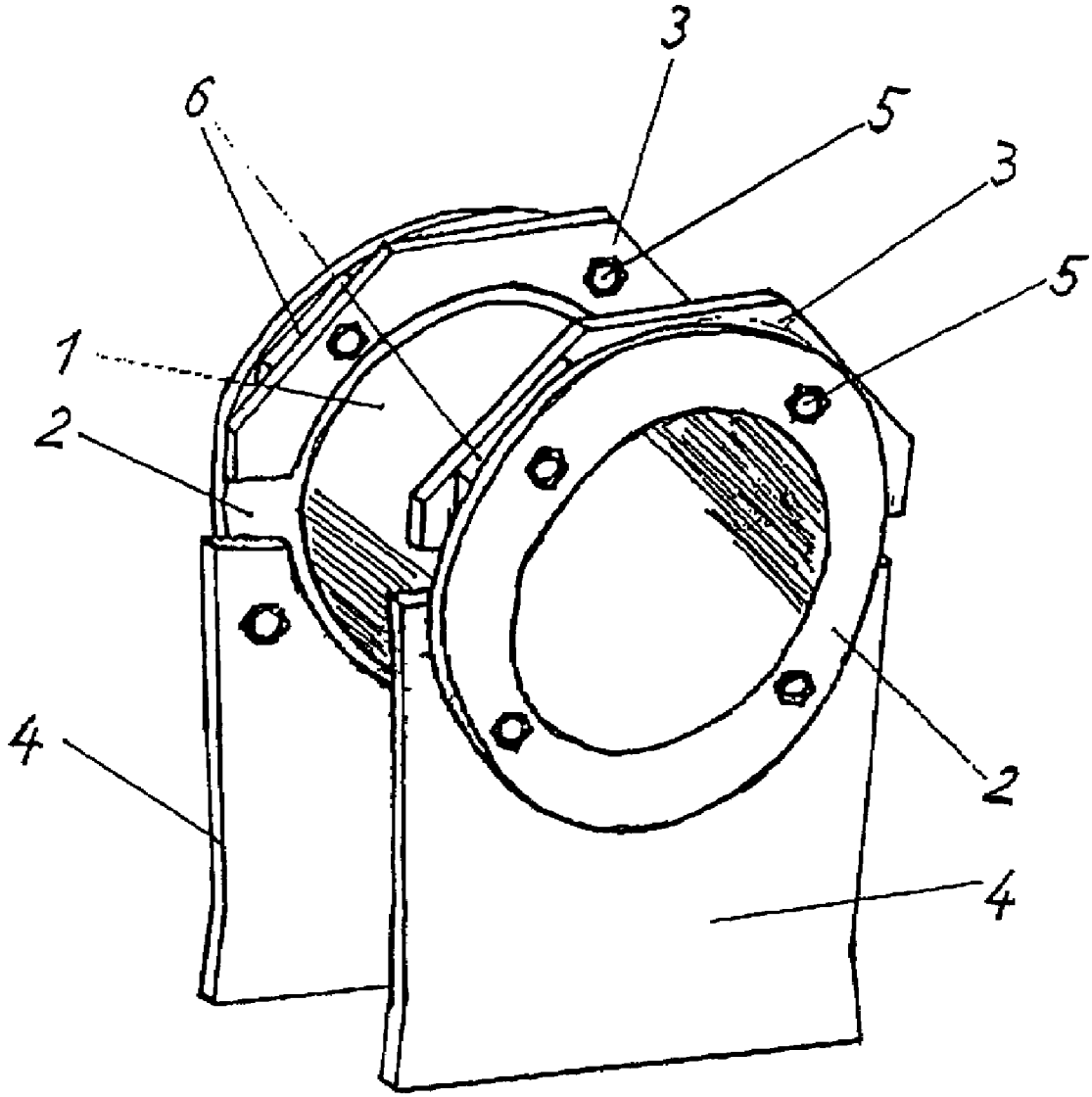
FIG. 1 shows a spatial representation of a cylindrical resonator with a supporting structure mounted at the flange, FIG. 2 diagrammatically shows the supporting surfaces between the flange and the supporting structure.

DESCRIPTION OF THE PREFERRED EMBODIMENTS:

As can be seen from FIG. 1, the cylindrical resonator consists of a cylindrical resonator wall 1, which has a flange 2 on both sides. Behind the front flange 2, there is an upper supporting element 3 and a lower supporting element 4, which are connected by means of screws 5 with the flange 2. At the connecting sites, between the supporting elements 3, 4 and the flange 2, there are spacers 6, of which only one each at the front and rear flange can be recognized in this representation. The lower supporting elements 4 differ from the upper supporting elements 3 owing to the fact that they have a larger flat region after their semicircular recess. This flat region serves for dissipating heat from the resonator as well as for fixing the resonator at the adjoining components.

Figure 2:
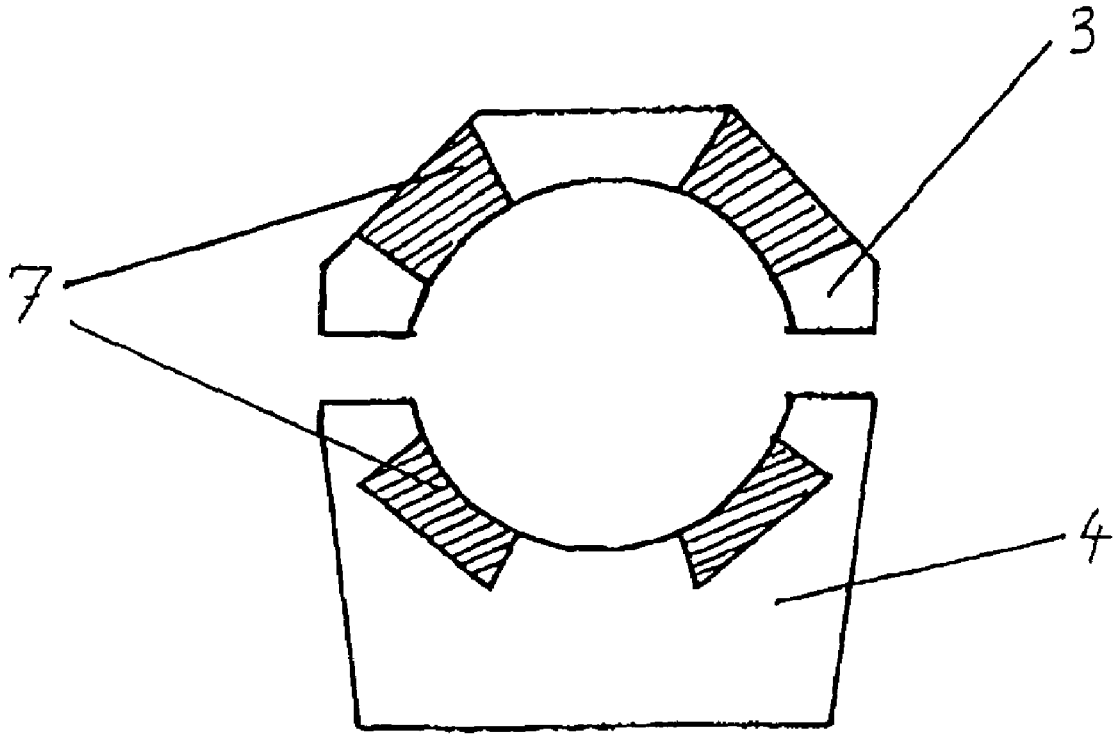
Figure 3:
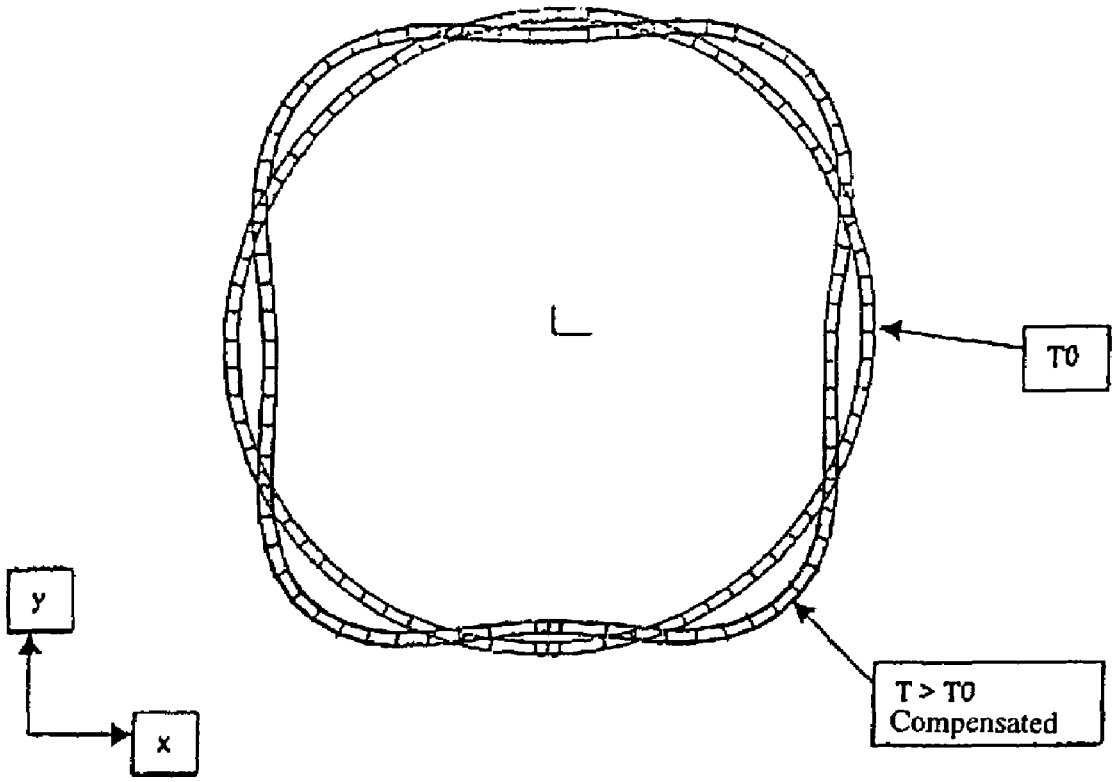
FIG. 3 shows a diagrammatic representation of the deformation on a highly enlarged scale.

FIG. 2 shows an upper supporting element 3 and a lower supporting element 4. The crosshatched regions represent supporting surfaces 7, at which the spacers 6 between the flange 2 and the supporting elements 3, 4 rest, over which the force is introduced into the cylindrical resonator. The supporting surfaces 7 are disposed so that the differential expansion between the cylindrical resonator and the supporting structure produces the deformation, which is shown on a much enlarged scale in FIG. 3. The deformation can be improved even more if spacers 6 with different coefficients of expansions, for example, when the upper spacers 6 consist of aluminum and the lower ones of invar, are used at the supporting surfaces 7. The deformation, shown in FIG. 3, shows that the circular resonator, because it is heated to a temperature T>TO, TO being the initial temperature of the circular resonator, for example, before it is used, is deformed uniformly in the x and y directions, as a result of which there is a uniform compensation on both modes.

All the distinguishing features, given in the description, the claims that follow and in the drawing, may be essential to the invention individually as well as in any combination with one another.

LIST OF REFERENCE NUMBERS 1 resonator wall
2 flange
3 upper supporting element
4 lower supporting element
5 screws
6 spacer
7 supporting surfaces

The invention claimed is:

1. Method for the temperature compensation at circular resonators with dual mode utilization, which includes a material with a low coefficient of thermal expansion and for which deformation forces including tensile or compressive forces are transferred to a resonator wall and produce elastic deformations there, comprising deforming the resonator wall at one or more places along an axial extent of the resonator wall in two mutually perpendicular directions by, in each case, the same absolute amount.

2. The method of claim 1, wherein the deformation forces are applied directly to the resonator wall.

3. The method of claim 1, wherein the deformation forces are introduced into the resonator wall over at least one flange.

4. Arrangement for compensating for temperature at a circular resonator with dual-mode utilization, comprising:

the circular resonator including a material with a low coefficient of thermal expansion, said circular resonator including a resonator wall and end faces, said circular resonator further including a flange at each of said end faces of the circular resonator;

at least two supporting structures for each said flange, said at least two supporting structures comprising a material with a coefficient of thermal expansion which is higher than the low coefficient of thermal expansion of the material of the circular resonator, said at least two supporting structures each lying in a respective plane perpendicular to an axis of the circular resonator and surrounding the circular resonator coaxially without touching the circular resonator; and uniformly radially distributed spacers being interposed between the flange of said circular resonator and said at least two supporting structures, said at least two supporting structures being connected with the flange of the circular resonator over said spacers.

5. The arrangement of claim 4, wherein the two supporting structures each enclose the circular resonator semicircularly.

6. The arrangement of claim 5, wherein the spacers have different coefficients of expansion.

7. The arrangement of claim 4, wherein the spacers have different coefficients of expansion.

8. The arrangement of claim 7, wherein some of said spacers are comprised of Invar and a remainder of said spacers are comprised of aluminum.

9. The arrangement of claim 7, further comprising screws for connecting said at least two supporting structures with said circular resonator at connecting sites at which said spacers are located.

10. The arrangement of claim 4, wherein a lower one of said at least two supporting structures includes a larger flat region than a corresponding flat region of an upper one of said at least two supporting structures.

* * * * *